US008272707B2

(12) United States Patent
Kashimoto

(10) Patent No.: US 8,272,707 B2
(45) Date of Patent: Sep. 25, 2012

(54) PRINTING DEVICE, CONTROL METHOD FOR A PRINTING DEVICE, A PROGRAM, AND A RECORDING MEDIUM

(75) Inventor: Yasuke Kashimoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 674 days.

(21) Appl. No.: 12/383,609

(22) Filed: Mar. 26, 2009

(65) Prior Publication Data

US 2009/0251503 A1 Oct. 8, 2009

(30) Foreign Application Priority Data

Mar. 27, 2008 (JP) ..... 2008-083890

(51) Int. Cl.
*B41J 29/38* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 6,464,319 | B1 | 10/2002 | Teshigawara et al. | |
| 2004/0080555 | A1* | 4/2004 | Otsuki et al. | 347/14 |
| 2005/0052481 | A1* | 3/2005 | Takahashi et al. | 347/8 |
| 2005/0269416 | A1* | 12/2005 | Sussmeier et al. | 235/494 |

FOREIGN PATENT DOCUMENTS

| | | |
|---|---|---|
| JP | 01-226342 A | 9/1989 |
| JP | 11-058709 A | 3/1999 |
| JP | 2000-127369 | 5/2000 |
| JP | 2002-205385 | 7/2002 |
| JP | 2003-266700 | 9/2003 |
| JP | 2005-138323 | 6/2005 |

* cited by examiner

*Primary Examiner* — Laura Martin
(74) *Attorney, Agent, or Firm* — Nutter McClennen & Fish LLP; John J. Penny, Jr.; Christopher J. Stow

(57) ABSTRACT

A printing device having a function that adjusts for deviation that occurs between ink droplet landing positions during bidirectional printing in which ink droplets of a plurality of dot sizes are discharged to print images on a print medium, comprising a print head that discharges ink droplets having a plurality of sizes, and a control unit that sets an adjustment value for the deviation for different types of images based upon a type of image being printed.

9 Claims, 10 Drawing Sheets

PRINTING DEVICE, CONTROL METHOD FOR A PRINTING DEVICE, A PROGRAM, AND A RECORDING MEDIUM

Applicant claims priority under 35 U.S.C. §119 to Japanese Patent Application No. 2008-083890 filed on Mar. 27, 2008, which is hereby incorporated by reference in its entirety.

BACKGROUND OF THE INVENTION

1. Field of Invention

The present invention relates to a printing device that performs the function of adjusting for deviation between the landing positions of ink droplets that are deposited on the outbound and return passes of the recording head during bidirectional printing in which the recording head discharges ink droplets of a plurality of different sizes to print an image on the print medium on both the outbound and return passes of the recording head. The invention also relates to a method of controlling the printing device, to a program, and to a recording medium.

2. Description of Related Art

FIG. 8 schematically describes a printing process executed by a printer with a bidirectional printing function according to the related art. This printer has a recording head 3 that is capable of discharging ink droplets of a plurality of sizes mounted on a carriage not shown, and prints images on a print medium (such as paper) 5 during both the outbound pass (also referred to as the "first pass") and the return pass of the recording head 3.

Referring to FIG. 8, the print medium 5 is conveyed in the paper feed direction indicated by arrow A in the figure by means of a transportation mechanism disposed inside the printer. A carriage not shown on which the recording head 3 is mounted is disposed to move bidirectionally in the direction perpendicular to the paper feed direction of the paper 5 by means of a guide mechanism 7 that extends perpendicularly to the paper feed direction of the paper 5.

The left end of the range in which the recording head 3 can be moved bidirectionally by the guide mechanism 7 is referred to as the column 0 side, and the right end of this range is the column 80 side. The printing process in which the recording head 3 is driven to print while traveling in the direction from column 0 to column 80 as indicated by arrow P1 in the figure is referred to as "outbound printing" or printing on the outbound or first pass, and the printing process in which the recording head 3 is driven to print while traveling in the direction from column 80 to column 0 as indicated by arrow P2 in the figure is referred to as "return printing" or printing on the return pass. Printing results from the recording head 3 operating in both the outbound printing mode and the return printing mode, that is, in both directions.

FIG. 9 shows the image G1 printed on the print medium 5 on the outbound pass, and the image G2 printed on the return pass. The nozzles of the recording head 3 for discharging ink droplets are arranged in a row and column pattern, and dot lines are printed on a plurality of rows (7 rows in this example) in a single pass in both outbound and return directions.

Bidirectional printing on both outbound and return passes of the recording head 3 requires bidirectional adjustment (also called gap adjustment) to correct for deviation in the landing positions of the ink droplets discharged on the outbound and return passes. This deviation in the ink droplet landing positions on the outbound and return passes differs according to the dot size of the discharged ink droplets.

Japanese Unexamined Patent Appl. Pub. JP-A-2003-266700 teaches a printing control method that efficiently applies this bidirectional adjustment by selecting a dot of an intermediate size as the reference dot during both outbound and return passes, or selecting the reference dot for outbound and return passes based on the printing mode (such as a photographic print mode and a text print mode) selected for the print job, and applies the bidirectional adjustment to eliminate deviation in the land positions of the selected reference dot.

When printing images as shown in FIG. 10, however, there may be plural images of different basic types on a single page S, including illustrations Q1, a barcode Q2, text Q3, or a photograph Q4. When printing a photograph Q4, for example, ink droplets forming small and medium size dots are normally discharged to enable printing high resolution pictures with rich gray scale variation. When printing a barcode Q2, however, ink droplets forming large dots are typically discharged to enable printing sharp barcodes that are easy to read. The dot size yielding the best print result thus varies according to the characteristics of the image Q1 to Q4 being printed.

This means that if bidirectional adjustment is applied using a uniform medium size dot as the reference dot, or bidirectional adjustment is applied using a reference dot selected according to the print mode, the ink droplet landing position can be sufficiently corrected for some types of images but not for other types of images, and image degradation may result in parts.

For example, because the print mode is generally selected once for an entire file or for individual pages of the image data file to be printed, the print mode will be selected referenced to one of the images Q1 to Q4 when printing the image file shown in FIG. 10. However, if the print mode is set to the photographic mode based on the photographic image, the photograph Q4 can be printed with high resolution and no deviation in the ink droplet landing positions, but resolution will drop in the barcode Q2 and text Q3 images because of the deviation in the ink droplet landing positions.

SUMMARY OF THE INVENTION

A printing device that prints bidirectionally using a recording head that can discharge ink droplets of a plurality of different sizes can prevent image degradation caused by deviation in the ink droplet landing positions in different images when printing image data containing plural images of different types, such as a barcode image and a photograph. Other aspects of the invention are a control method for this printing device, a program, and a recording medium.

A first aspect of at least one embodiment of the invention is a printing device having a function that adjusts for deviation that occurs between ink droplet landing positions on the outbound pass and return pass during bidirectional printing in which ink droplets of a plurality of dot sizes are discharged from a recording head during both the outbound and return passes of the recording head to print images on a print medium, wherein when printing image data containing a large-dot image that is printed using mostly large dots and an image that is not a large-dot image, the printing device prints bidirectionally using a large-dot adjustment value that is the adjustment value for said deviation when printing large-dot images, and prints bidirectionally using an adjustment value for dot sizes other than large dots when printing an image other than a large-dot image.

Another aspect of at least one embodiment of the invention is a control method for a printing device having a function that adjusts for deviation that occurs between ink droplet landing positions on the outbound pass and return pass during bidirectional printing in which ink droplets of a plurality of dot sizes are discharged from a recording head during both the outbound and return passes of the recording head to print images on a print medium, the control method including steps of printing bidirectionally using a large-dot adjustment value that is the adjustment value for said deviation when printing large-dot images, and printing bidirectionally using an adjustment value for dot sizes other than large dots when printing an image other than a large-dot image, when printing image data containing a large-dot image that is printed using mostly large dots and an image that is not a large-dot image.

This aspect of the invention can prevent image degradation resulting from deviation in the ink droplet landing positions because the adjustment value for deviation can be set appropriately for each image when printing image data containing a mixture of different image types including a large-dot image that is printed using mostly large dots and an image that is not a large-dot image.

A printing device according to another aspect of at least one embodiment of the invention has a storage unit that stores adjustment values set for each dot size according to the amount of deviation; an image buffer in which image data converted to raster data is stored; and a printing control unit that recognizes ordered dot data as a ruled line when a plurality of dots are converted in an ordered line in a direction perpendicular to the raster, determines if the number of ruled lines exceeds a predetermined threshold count in the raster direction, and controls bidirectional printing using the large-dot adjustment value stored in the storage unit when the number of ruled lines exceeds the predetermined threshold count.

A control method for a printing device according to another aspect of at least one embodiment of the invention also has a step of storing adjustment values set for each dot size according to the amount of deviation in a storage unit; a step of converting image data to raster data and storing the raster data; and a control step of controlling recognizing ordered dot data as a ruled line when a plurality of dots are converted in an ordered line in a direction perpendicular to the raster direction, determining if the number of ruled lines exceeds a predetermined threshold count in the raster direction, and controlling bidirectional printing using the large-dot adjustment value stored in the storage unit when the number of ruled lines exceeds the predetermined threshold count.

This aspect of the invention recognizes ordered dot data as a ruled line when a plurality of dots are converted in an ordered line in a direction perpendicular to the raster, and prints bidirectionally using the large-dot adjustment value stored in the storage unit if the number of ruled lines exceeds the predetermined threshold count. More specifically, images that contain more ruled lines in the raster direction than a predetermined threshold value are printed bidirectionally using the large-dot adjustment value. The possibility of ruled lines being formed in text data and photographic images is low. As a result, if the number of ruled lines exceeds the threshold value, the image can be recognized as data other than text data or a photographic image that does not require a high print density. Conversely, if the number of ruled lines is less than the threshold value, the image data can be recognized as text data or a photograph, for example.

As a result, the adjustment value that is used can be automatically changed according to the type of image data during bidirectional printing, and image degradation caused by deviation in the ink droplet landing positions in different images can be prevented. In addition, images that require particularly high print density can be bidirectionally printed using the large-dot adjustment value.

In a printing device according to another aspect of at least one embodiment of the invention the printing control unit determines if the number of ruled lines exceeds a predetermined threshold count in the raster direction for each group of raster data equal to one scan of the recording head, and acquires the adjustment values for a dot size other than the large dot size stored in the storage unit and prints bidirectionally using the acquired adjustment value if the number of ruled lines does not exceed the predetermined threshold count in the raster direction for each group of raster data equal to one scan of the recording head.

In a printing device control method according to another aspect of at least one embodiment of the invention the control step includes a step of determining if the number of ruled lines exceeds a predetermined threshold count in the raster direction for each group of raster data equal to one scan of the recording head, acquiring the adjustment value for a dot size other than the large dot size stored in the storage unit, and printing bidirectionally using the acquired adjustment value if the number of ruled lines does not exceed the predetermined threshold count in the raster direction for each group of raster data equal to one scan of the recording head.

Because whether the number of ruled lines exceeds a predetermined threshold count in the raster direction is determined for each group of raster data equal to one scan of the recording head, the adjustment value setting can be changed for each group of raster data equal to one scan of the recording head. Therefore, even if the image data to be printed contains text, a photograph, and an image containing more ruled lines than the threshold value, the adjustment value for the portion containing more ruled lines than the threshold count, and the adjustment value for the portion containing text and a photograph, can be automatically changed for each scan by the recording head.

In the printing device according to at least one embodiment of the present invention the large dot size is preferably a dot size suitable for printing a barcode, and the other dot size is a dot size suitable for printing images other than barcode images.

Yet further preferably, the large-dot image is a barcode image.

The large-dot adjustment value corresponding to the large dot size that is set when the number of ruled lines exceeds the threshold count is the large-dot adjustment value corresponding to the dot size suitable for printing barcodes. More specifically, data containing more ruled lines than the threshold value can be recognized as barcode data, and the large-dot adjustment value that is appropriate to barcode printing is set. Because barcodes are thus printed at a high print density, barcodes that are sharp and easy to read can be printed.

Another aspect of at least one embodiment of the invention is a program causing a computer to execute the control method for a printing device described above.

Yet another aspect of at least one embodiment of the invention is a computer-readable recording medium storing the program.

These aspects of the invention provide a program enabling automatically changing the adjustment value that is used according to the type of image data and thereby preventing image degradation caused by deviation in the ink droplet landing positions in the printed images, an a recording medium for storing this program.

Other objects and attainments together with a fuller understanding of the invention will become apparent and appreciated by referring to the following description and claims taken in conjunction with the accompanying drawings.

DESCRIPTION OF PREFERRED EMBODIMENTS

Preferred embodiments of a printing device and a method of controlling a printing device according to the present invention are described below with reference to the accompanying figures.

Figure 1:
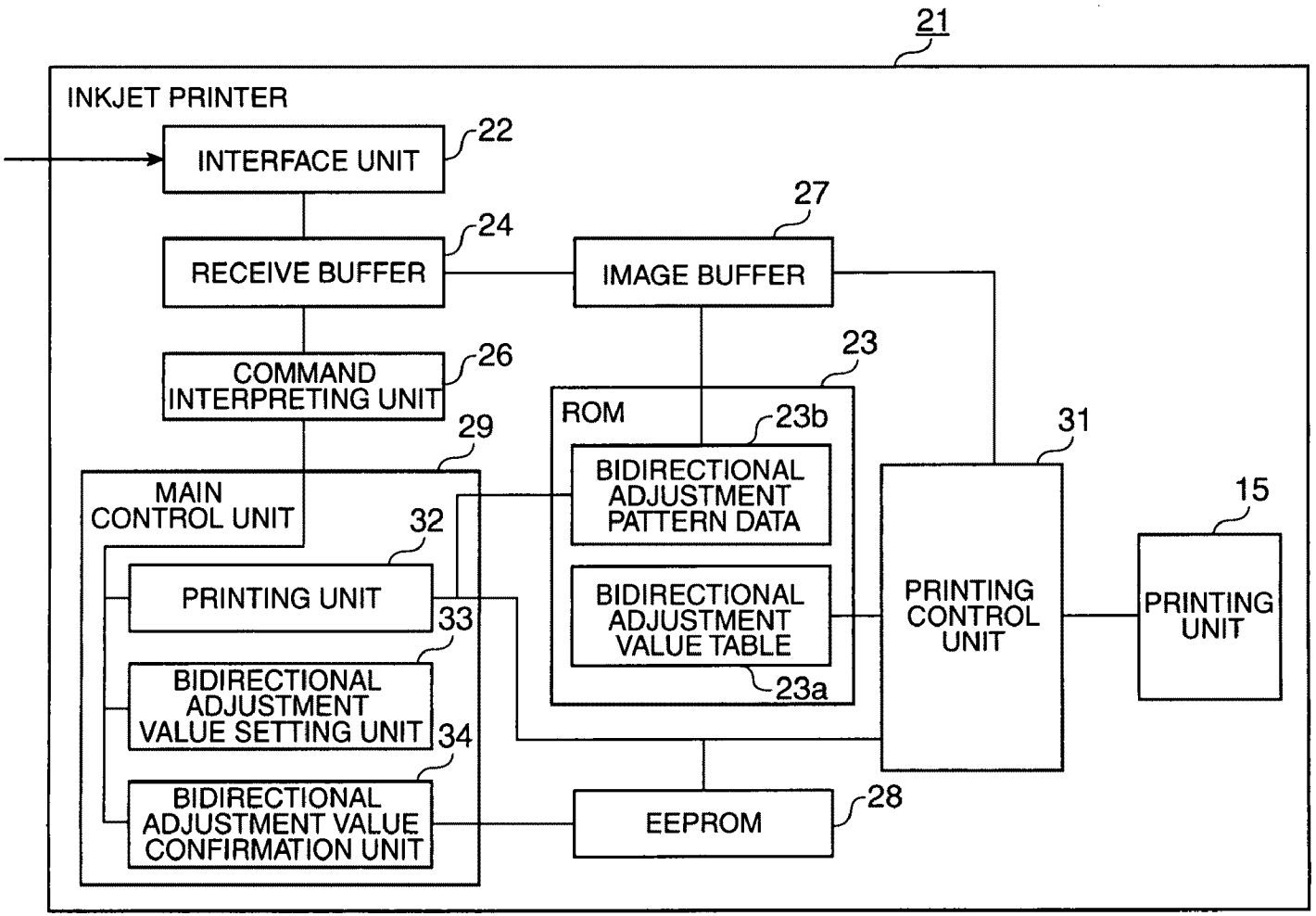
FIG. 1 is a block diagram showing the configuration of an inkjet printer according to a preferred embodiment of the invention.

Based on print data including commands and image data input from a host computer not shown, the inkjet printer 21 shown in FIG. 1 outputs predetermined control signals and print signals to the printing unit 15 to execute a printing process according to the print data. This inkjet printer 21 also has a bidirectional printing function whereby ink droplets of a set dot size are discharged from the recording head onto the print medium on both the outbound (first) and return passes of the bidirectional movement of the carriage in order to print an image on the print medium during both the first and return passes of the carriage.

The function of adjusting for the deviation that occurs between the positions where the ink droplets are deposited on the print medium on the first and return passes during bidirectional printing in which images are printed on the print medium on both the outbound and return passes of the recording head is referred to herein as "bidirectional adjustment," and the corresponding adjustment value is referred to as the "bidirectional adjustment value."

The inkjet printer 21 according to this embodiment of the invention has an interface unit 22, ROM 23, a receive buffer 24, a command interpreting unit 26, an image buffer 27, EEPROM 28, a main control unit 29, a printing control unit 31, and a printing unit 15. In addition, the main control unit 29 in this embodiment of the invention forms at least a printing unit 32, a bidirectional adjustment value setting unit 33, and a bidirectional adjustment value confirmation unit 34 by executing firmware using a CPU not shown.

The print data and commands sent from the host computer through the interface unit 22 are temporarily stored in the receive buffer 24. Image data contained in the print data stored in the receive buffer 24 is converted to raster data and stored in the image buffer 27. Print commands and other commands are interpreted by the command interpreting unit 26, and the main control unit 29 includes various functional units according to the result of command interpretation.

If the received command is a print command, the printing unit 32 instructs the printing control unit 31 to execute the printing process. Based on this printing instruction, the printing control unit 31 controls bidirectional printing using the adjustment value for the dot size to be used.

If the received command is the bidirectional adjustment pattern print command, the printing unit 32 instructs the printing control unit 31 to print the test pattern. When the test pattern print command is received, the printing control unit 31 drives the printing unit 15 to print the test pattern shown in FIG. 3 on the print medium based on the bidirectional adjustment value table 23*a*.

If the received command is the bidirectional adjustment value setting command, the bidirectional adjustment value setting unit 33 enables the bidirectional adjustment value setting mode. The bidirectional adjustment value confirmation unit 34 stores the bidirectional adjustment value corresponding to the adjustment pattern number P1 to P9 (see FIG. 3) input by the user in the bidirectional adjustment value setting mode in EEPROM 28. Note that the inkjet printer 21 in this embodiment of the invention has at least three dot sizes, referred to as large, medium, and small, wherein a large dot has a size that is larger than a size of a medium dot, and a medium dot has a size that is larger than a size of a small dot. As a result, bidirectional adjustment can be applied to each dot size, and bidirectional adjustment values set for each dot size are stored in EEPROM 28. A representative size of a "large dot," a "medium dot," and a "small dot" is 80 μm, 50 μm, 30 μm, respectively. However, the sizes of a "large dot," a "medium dot," and a "small dot" vary according to the type of paper that is used and according to the size and type of print head nozzles that are used. The present invention is in no way limited to specific sizes for the "large dot," "medium dot," and "small dot."

The printing control unit 31 drives the printing unit 15 and controls the printing process based on the image data converted into the image buffer 27 in response to a command from the printing unit 32. During this operation, the printing control unit 31 controls bidirectional printing while correcting the deviation in the landing positions of the ink droplets on the outbound and return passes based on the bidirectional adjustment values set in EEPROM 28.

While not shown in detail in the figures, the printing unit 15 includes a carriage and a recording head that is mounted on the carriage. The nozzles formed in the printing surface of the recording head can discharge ink droplets of plural different sizes, and the recording head can be controlled to discharge dots sized appropriately according to the color density of the printed image.

ROM 23 stores a bidirectional adjustment value table 23*a* and bidirectional adjustment pattern data 23*b*. The bidirectional adjustment values corresponding to the deviation in the landing positions of the ink droplets on the outbound and return passes of the recording head are set for each dot size in the bidirectional adjustment value table 23*a*.

For example, if the dot size is large, the adjustment value is set to delay the ink discharge timing so that the ink droplet is not deposited early. If the dot size is small, the adjustment value is set to advance the ink discharge timing so that the ink droplet is not deposited late. The bidirectional adjustment values are referenced when the printing start position is shifted. Note that the bidirectional adjustment values can be applied to both the outbound and return printing passes, or to only one of the passes.

Figure 2A:
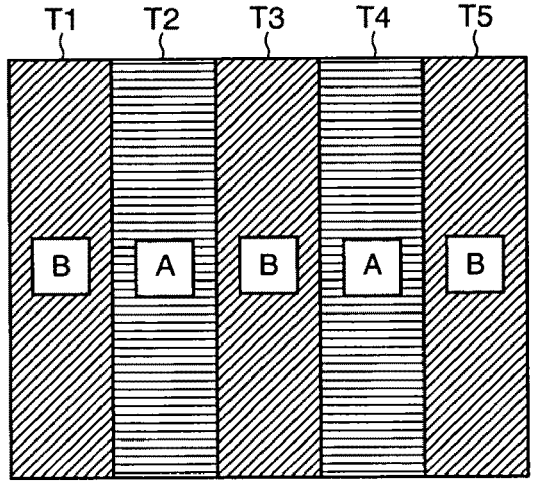
FIG. 2 describes the configuration of the bidirectional adjustment patterns used for bidirectional adjustment of the inkjet printer shown in FIG. 1.

The bidirectional adjustment pattern data 23*b* arranges five block patterns T1 to T5 as shown in FIG. 2A so that the block pattern A printed on the outbound printing pass and the block pattern B printed on the return printing pass are printed alternately in the direction of carriage movement.

Figure 2B:
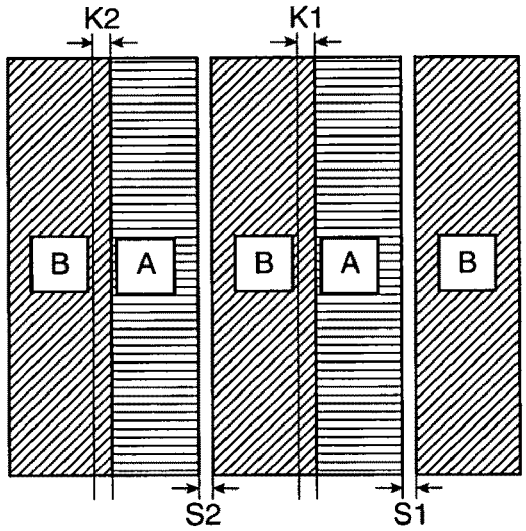

When the dot discharge timing on the return pass is advanced relative to the timing on the first pass, the resulting deviation in the ink droplet landing positions produces gaps S1, S2 and overlaps K1, K2 between adjacent block patterns as shown in FIG. 2B.

Figure 2C:
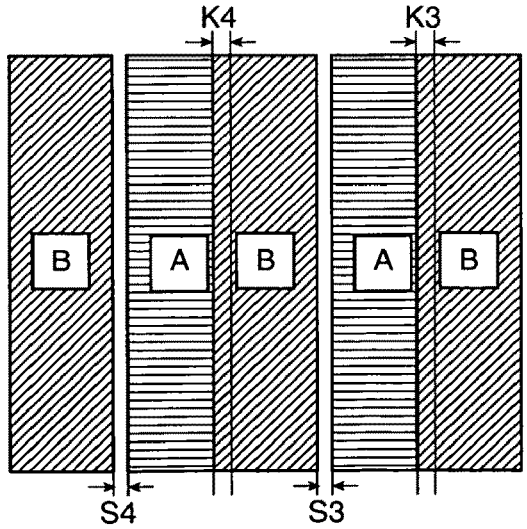

When the dot discharge timing on the return pass is delayed relative to the timing on the first pass, the resulting deviation in the ink droplet landing positions produces gaps S3, S4 and overlaps K3, K4 between adjacent block patterns as shown in FIG. 2C.

Based on how these gaps and overlaps are formed, the user can therefore determine the direction in which the dot discharge timing on the return path should be adjusted (that is, advanced or delayed).

If the ink droplet landing positions coincide on the outbound and return passes, the block patterns are printed with no gaps or overlaps between the adjacent block patterns as shown in FIG. 2A.

Figure 3:
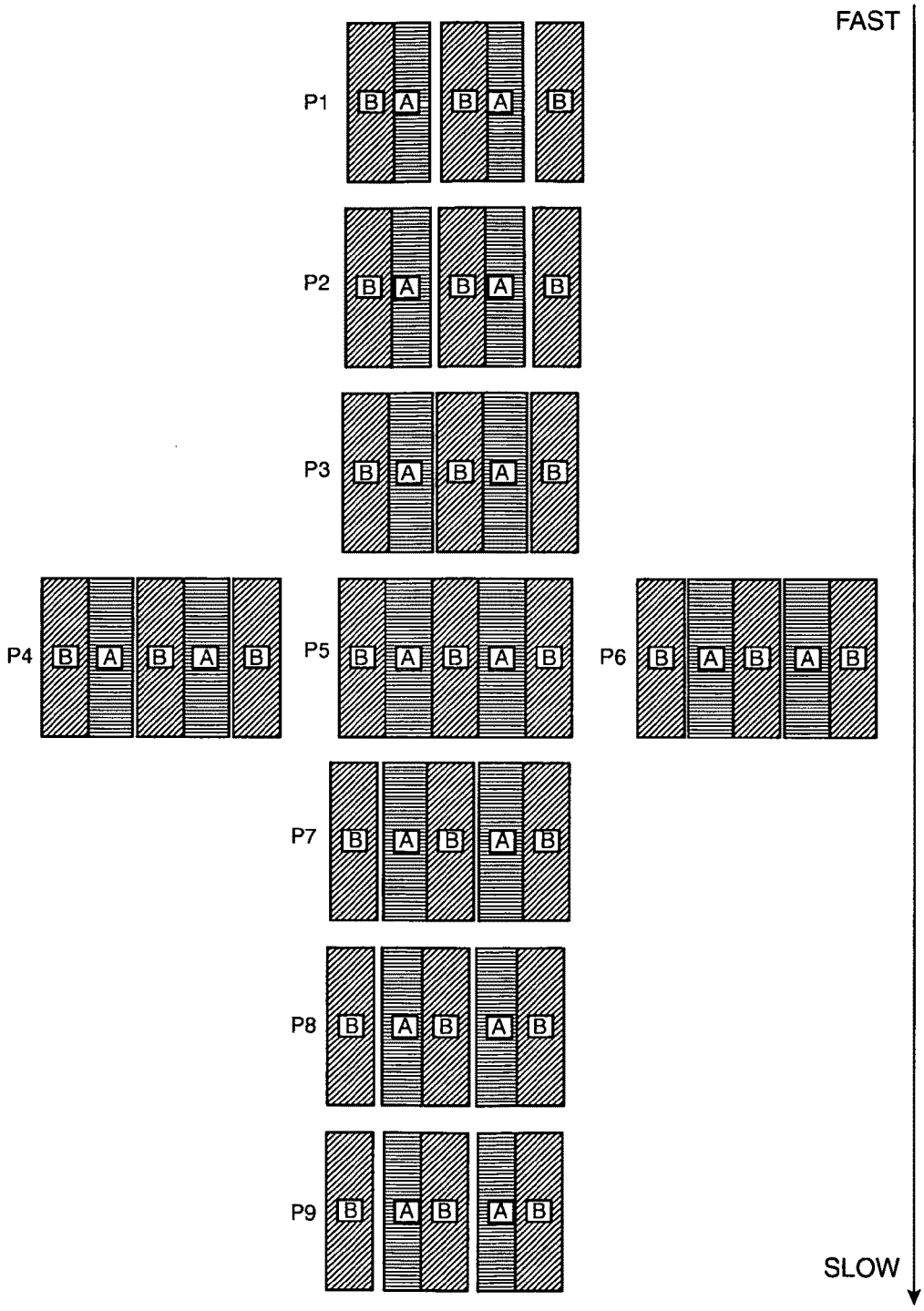
FIG. 3 describes the test patterns printed during bidirectional adjustment.

Nine test pattern variations P1 to P9 of the bidirectional adjustment pattern shown in FIG. 2A are printed as shown in FIG. 3 in the bidirectional adjustment process in this embodiment of the invention. When the bidirectional adjustment value is set appropriately, the bidirectional adjustment value P5 in the middle of the nine preset bidirectional adjustment values is normally printed as the appropriate bidirectional adjustment pattern.

However, the appropriate bidirectional adjustment pattern may not be printed at P5 and deviation may occur in the actual print result due to individual differences between printing units 15 caused by differences in the assembly, durability, and aging of the mechanical portion of the printing unit 15. More specifically, the preferred bidirectional adjustment pattern shown in FIG. 2A may be printed at P4 or P6, for example, instead of P5.

When the position of the preferred bidirectional adjustment pattern is thus shifted and the test pattern is printed, the user controls the bidirectional adjustment by simply inputting the number of the test pattern (also referred to as the adjustment pattern number) where the bidirectional adjustment pattern is desirably printed with no gaps or overlaps.

Figure 4:
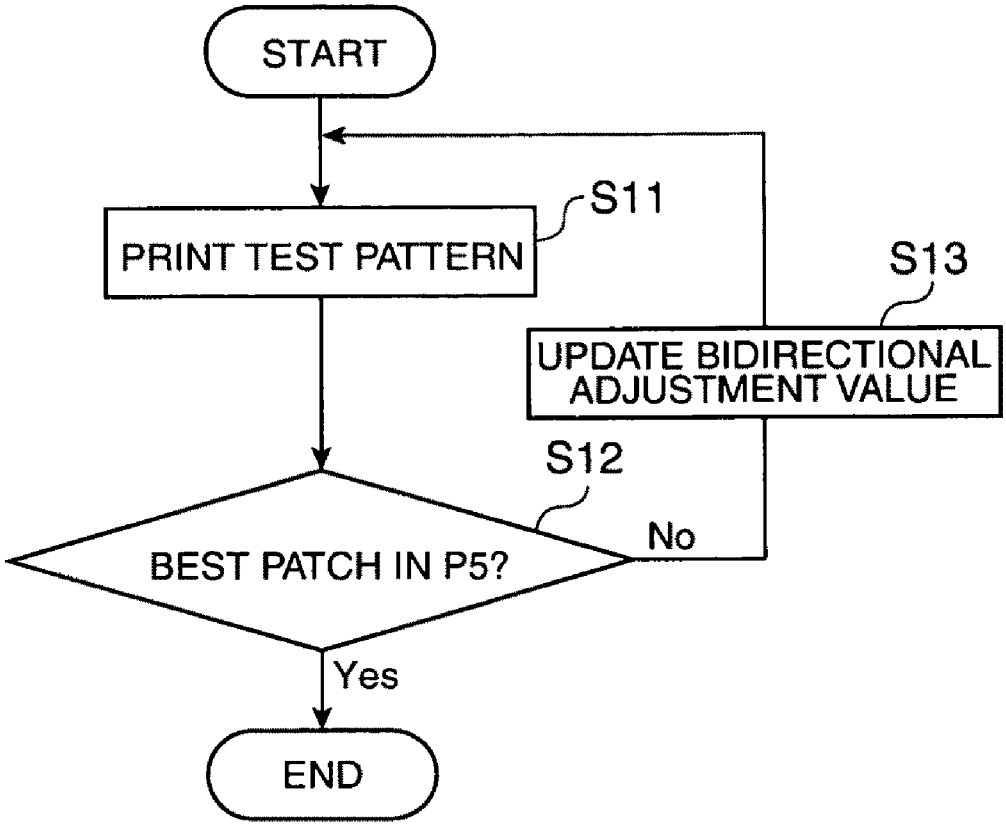
FIG. 4 is a flow chart describing the bidirectional adjustment value setting mode.

The bidirectional adjustment value setting mode is described next. FIG. 4 is a flow chart describing the bidirectional adjustment value setting mode.

The user issues a bidirectional adjustment command through an input unit not shown. Based on this command the host computer generates and sends a bidirectional adjustment value setting command to the inkjet printer 21.

The bidirectional adjustment value setting unit 33 then executes the bidirectional adjustment mode. When the bidirectional adjustment pattern print command is then received, the printing unit 32 tells the printing control unit 31 to print the test pattern, and the printing unit 15 then prints the test pattern (step S11).

The user then examines the printed test patterns and determines which one corresponds to the desirable bidirectional adjustment pattern having no gaps or overlaps, and inputs the appropriate adjustment pattern number. The bidirectional adjustment value setting unit 33 then determines if the input adjustment pattern number is P5 (step S12). If the input adjustment pattern number is P5 (step S12 returns Yes), the appropriate bidirectional adjustment value is determined to be set and the bidirectional adjustment value setting mode ends.

However, if the input adjustment pattern number is not P5 (step S12 returns No), the bidirectional adjustment value confirmation unit 34 updates the bidirectional adjustment value based on the adjustment pattern number according to the bidirectional adjustment value confirmation command (step S13). Steps S11 to S13 then repeat until the adjustment pattern number input by the user is P5.

The printing process executed for bidirectional adjustment by the inkjet printer 21 described above is described next.

Figure 5:
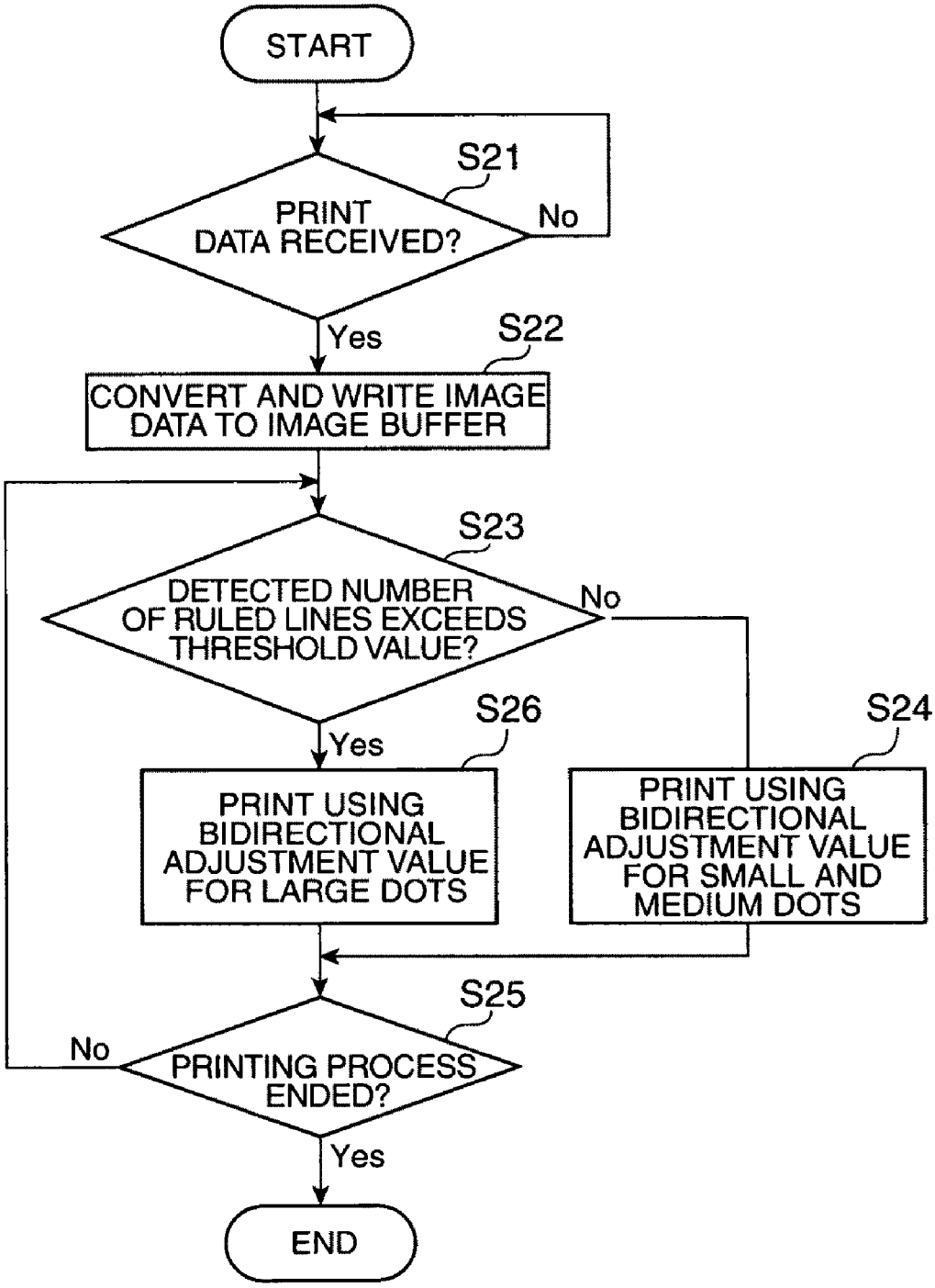
FIG. 5 is a flow chart describing the printing process accompanying bidirectional adjustment by the inkjet printer in a preferred embodiment of the invention.
Figure 6:
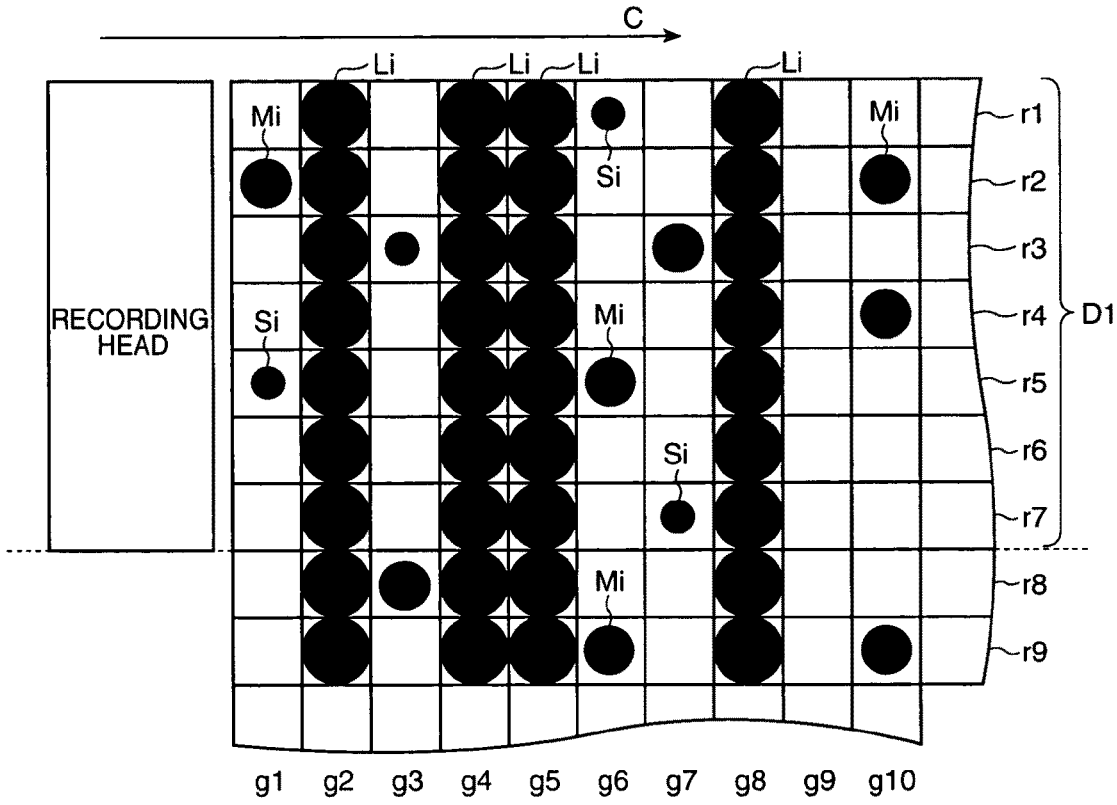
FIG. 6 describes the sequence of the ink droplets in plural adjacent raster lines.
Figure 7:
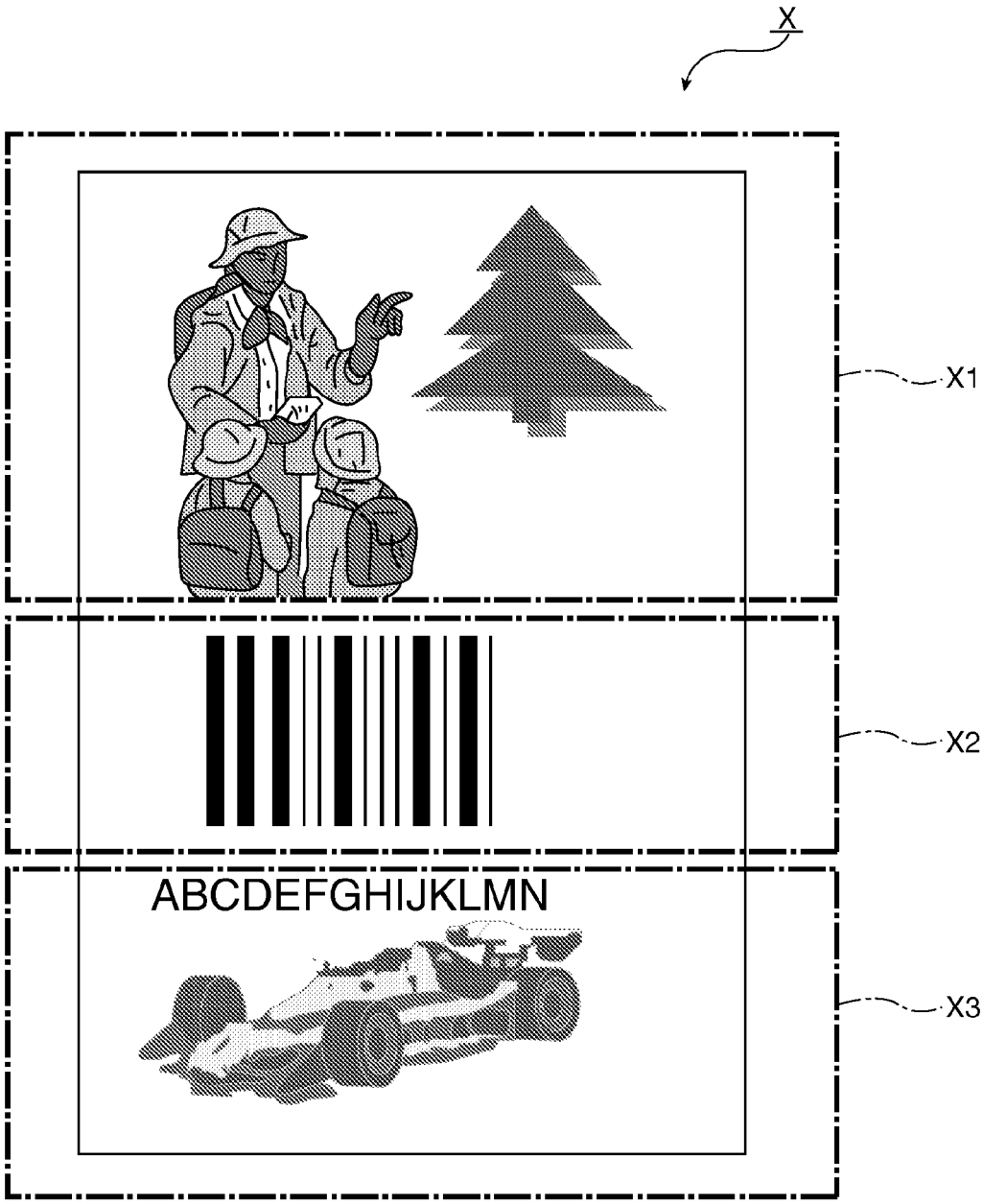
FIG. 7 shows a sample of the print data printed in a preferred embodiment of the invention.
Figure 8:
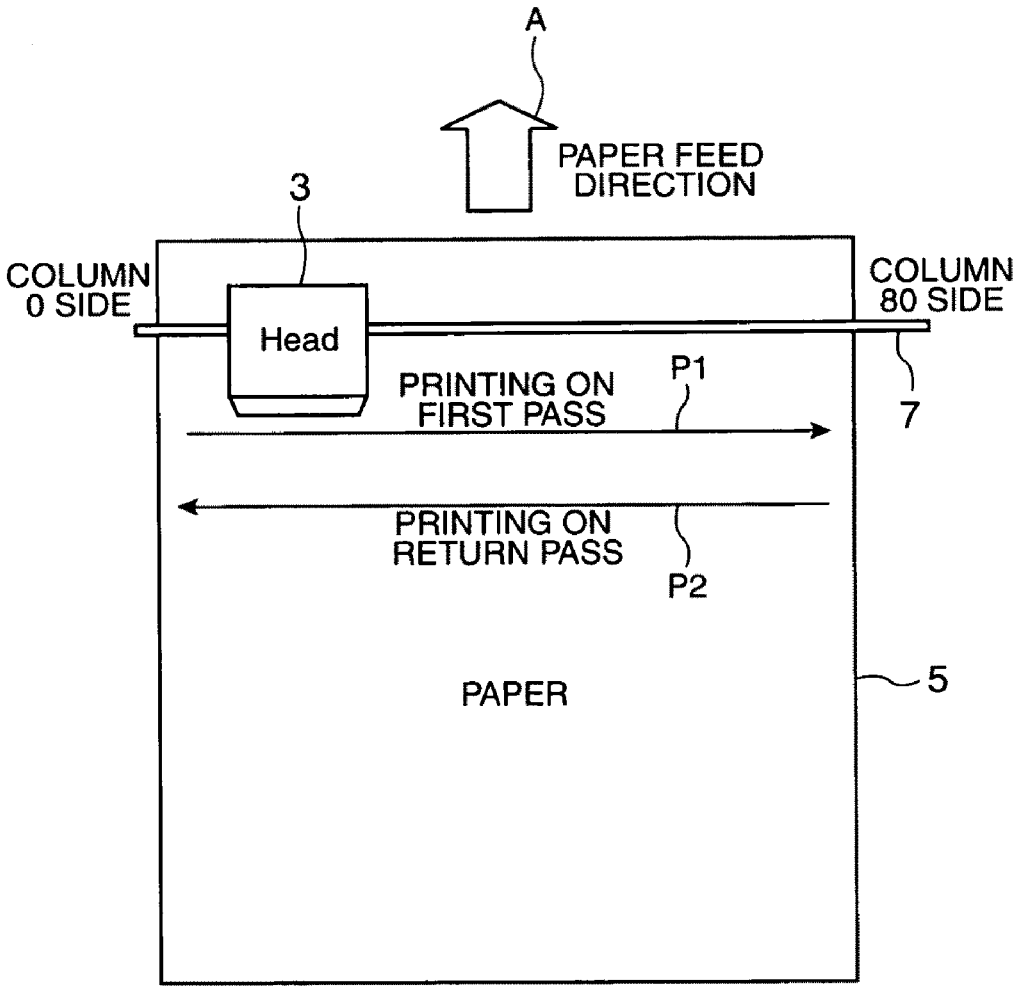
FIG. 8 schematically describes the printing process of a printing device that prints bidirectionally using a recording head capable of discharging ink droplets for a plurality of dot sizes.
Figure 9:
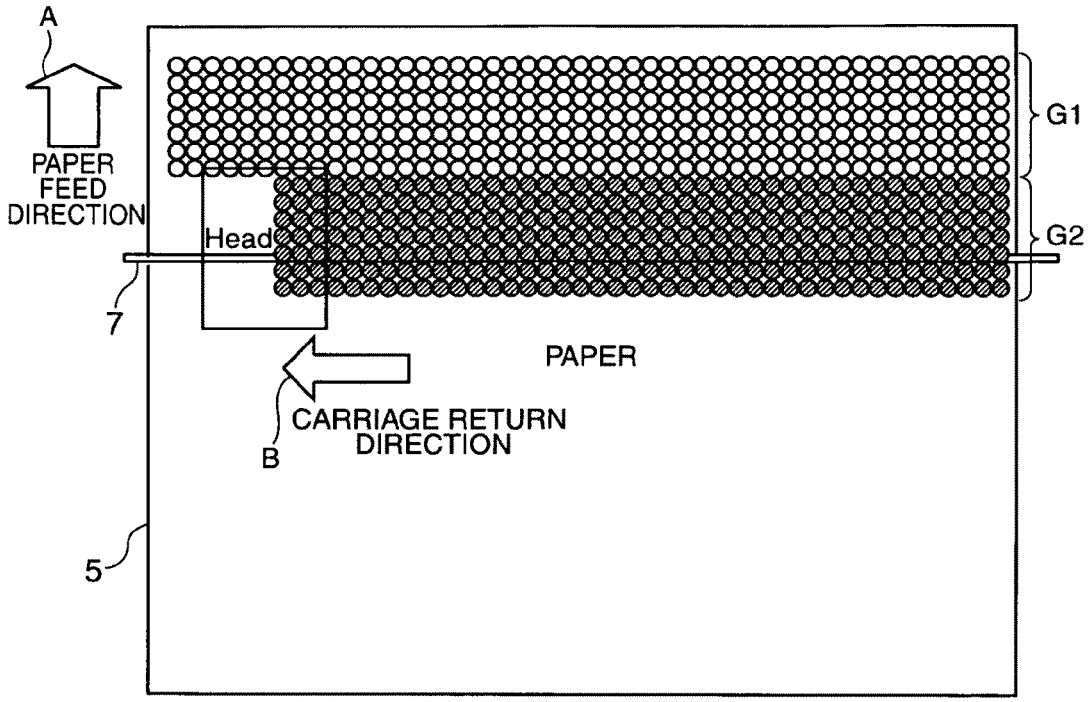
FIG. 9 describes an example of an image printed by printing on both the outbound and return printing passes in a bidirectional printing process.
Figure 10:
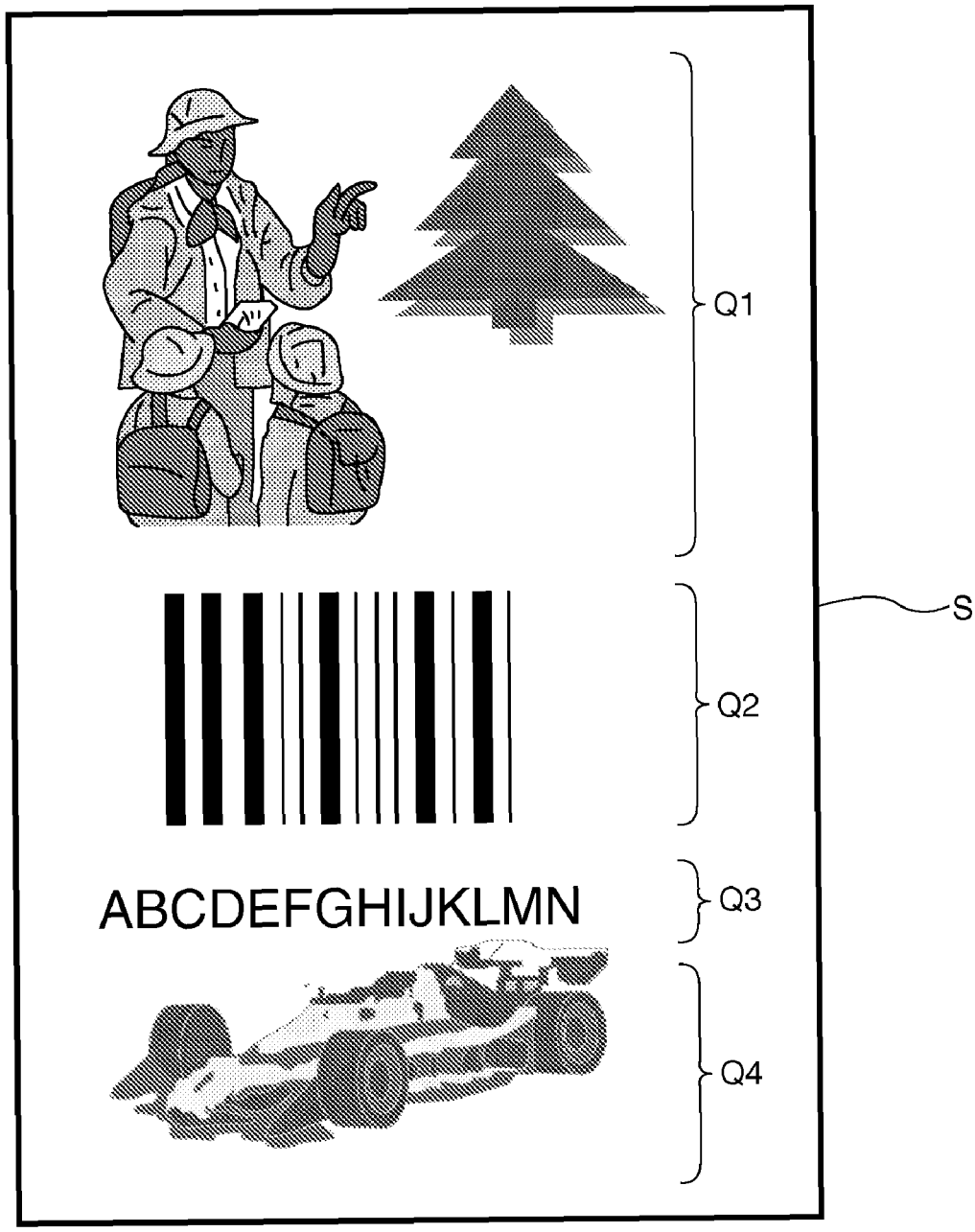
FIG. 10 shows an example of image data containing plural images of different types.

FIG. 5 is a flow chart describing the printing process executed for bidirectional adjustment by the inkjet printer according to this embodiment of the invention. FIG. 6 schematically describes the sequence of ink droplets printed to a plurality of adjacent raster lines. FIG. 7 shows an example of the image data printed in this embodiment of the invention.

This embodiment of the invention describes printing image data X containing a large-dot image (a barcode image X2) that is printed using mostly large dots, and images (such as illustrations X1 and X3) that are not large-dot images. The term "mostly large dots" means that the number of large dots is larger than the sum of the number of medium and small dots.

When print data containing this image data X is received (step S21 returns Yes), the image data X is converted to raster data and stored in the image buffer 27 (step S22).

FIG. 6 shows the sequence of ink droplets on a plurality of adjacent raster lines r1 to r9. Note that large-dot ink droplets are denoted Li, medium-dot ink droplets are denoted Mi, and small-dot ink droplets are denoted S1. Arrow C in FIG. 6 indicates the direction of recording head movement on the outbound or first pass. The direction of recording head movement on the return pass is in the opposite direction as arrow C. For convenience describing the invention, the pixel numbers (g1 to g10) are also indicated sequentially from left to right below the last raster line r9.

Whether a group of ruled lines exceeding a predetermined threshold count is present in the image data written to the image buffer 27 is then determined (step S23). A method of detecting ruled lines is described next.

As shown in FIG. 6 a small ink droplet S1 is at pixel position g6 in the top raster line r1, and large ink droplets Li are at pixel positions g2, g4, g5, and g8. In FIG. 6 a row of plural dots perpendicular to the raster line are stored at pixel positions g2, g4, g5, and g8. More particularly, lines of large dots Li are formed continuously through the adjacent raster lines r1 to r9. Of these raster lines r1 to r9, the group of raster lines r1 to r7 equal to one pass of the recording head are referred to as single-pass data D1, and the rows of dots at pixel positions g2, g4, g5, and g8 in this single-pass data D1 are ruled lines. Whether the number of such ruled lines exceeds the predetermined threshold count is determined for each unit of single-pass data D1.

Because an illustration X1 is normally printed using small dots and medium dots, a number of ruled lines exceeding the threshold value is not detected from the raster data for the illustration X1 (step S23 returns No), and bidirectional printing therefore proceeds (step S24) using the bidirectional adjustment values for small dots and medium dots that were stored in EEPROM 28 during a previous bidirectional adjustment operation. If the printing process has not ended (step S25 returns No), steps S23 to S25 repeat.

A barcode image X2, however, must normally be printed with high print density using large dots because of the need for reading accuracy. Ruled lines exceeding the threshold count are therefore detected from the barcode image X2 (step S23 returns Yes), and the image can therefore be recognized as a barcode. The bidirectional adjustment value is therefore changed to the bidirectional adjustment value for large dots ("large-dot adjustment value") and bidirectional printing then proceeds (step S26). If the printing process has not ended (step S25 returns No), steps S23 to S25 repeat.

In addition, because illustration X3 is normally printed using small dots and medium dots, a number of ruled lines exceeding the threshold value is not detected from the raster data for the illustration X3 (step S23 returns No), and bidirectional printing therefore proceeds (step S24) using the bidirectional adjustment values for small dots and medium dots that were also used to print illustration X1. If the printing process has not ended (step S25 returns No), steps S23 to S25 repeat.

Note that in this embodiment of the invention the threshold value used for the evaluation in step S23 can be freely set and changed according to the barcode type and specification, for example, and these values can be stored in EEPROM 28 for reference.

As described above, when printing image data X containing different types of images, such as barcode images X2 and other large-dot images that are printed using mostly large dots, and images such as illustrations X1 and X3 that are not large-dot images, the inkjet printer 21 according to this embodiment of the invention can set the value that is used to adjust for the deviation that occurs during bidirectional printing separately for each image, and can therefore prevent image degradation caused by deviation in the ink droplet landing positions.

In addition, if the dot data is formed in ordered columns perpendicularly to the raster direction, the column dot data forms ruled lines, and the number of ruled lines in the raster direction exceeds a predetermined threshold count, bidirectional printing is executed using the large-dot adjustment value corresponding to the large-dot size. More specifically, images such as a barcode X2 having more ruled lines than the threshold count in the raster direction are printed bidirectionally using the large-dot adjustment value.

The possibility of ruled lines in text data and photographic images, however, is low. As a result, if the number of ruled lines exceeds the threshold value, the image is not text data or a photographic image that does not require a high print density, and can be recognized as a barcode.

Conversely, if the number of ruled lines is less than the threshold value, the image data can be recognized as data for an illustration X1, X3 such as for text or photograph.

As a result, the adjustment value that is used can be automatically changed according to the type of image data during bidirectional printing, and image degradation in different images caused by deviation in the ink droplet landing positions can be prevented. In addition, barcode images X2 that require particularly high print density can be bidirectionally printed using the large-dot adjustment value.

Furthermore, because the number of ruled lines is evaluated in step S23 for each block of single-pass data D1, which is equivalent to a single scan of the recording head, the adjustment value can be reset for each block of single-pass data D1 equivalent to a single scan of the recording head. Therefore, even if the image data to be printed contains text, a photograph, and an image containing more ruled lines than the threshold value, the adjustment value for the portion X2 containing more ruled lines than the threshold count, and the adjustment value for the portions X1 and X3 containing text and a photograph, can be automatically changed for each scan by the recording head.

The large-dot adjustment value corresponding to the large dot size that is set when the number of ruled lines exceeds the threshold count is the large-dot adjustment value corresponding to the dot size suitable for printing barcodes. More specifically, data containing more ruled lines than the threshold value can be recognized as image data for a barcode, and the large-dot adjustment value that is appropriate to barcode printing is set. Because barcodes are thus printed at a high print density, barcodes that are sharp and easy to read can be printed.

The invention being thus described, it will be clear that it may be varied in many ways. Such variations are not to be regarded as a departure from the spirit and scope of the invention, and all such modifications as would be understood by one skilled in the art are intended to be included within the scope of the following claims.

What is claimed is:

1. A printing device having a function that adjusts for deviation that occurs between ink droplet landing positions on an outbound pass and a return pass during bidirectional printing in which ink droplets of a plurality of dot sizes are discharged to print images on a print medium, comprising a print head that discharges ink droplets having a plurality of sizes; and a control unit that sets an adjustment value for said deviation for different types of images based upon a type of image being printed, a storage unit that stores adjustment values set for each dot size according to the deviation;

an image buffer in which image data converted to raster data is stored; and a printing control unit that recognizes ordered dot data as a ruled line when a plurality of dots are converted in an ordered line in a direction perpendicular to the raster, determines if the number of ruled lines exceeds a predetermined threshold count in the raster direction, and controls bidirectional printing using a large-dot adjustment value stored in the storage unit when the number of ruled lines exceeds the predetermined threshold count.

2. The printing device described in claim 1, wherein:

the printing control unit determines if the number of ruled lines exceeds a predetermined threshold count in the raster direction for each group of raster data equal to one scan of the recording head, and acquires the adjustment value for a dot size other than the large dot size stored in the storage unit and controls bidirectional printing using the acquired adjustment value if the number of ruled lines does not exceed the predetermined threshold count in the raster direction for each group of raster data equal to one scan of the recording head.

3. The printing device described in claim 1, wherein:

the large dot size is a dot size suitable for printing a barcode; and the other dot size is a dot size suitable for printing images other than barcode images.

4. The printing device described in claim 1, wherein:

the large-dot image is a barcode image.

5. A control method for a printing device having a function that adjusts for deviation that occurs between ink droplet landing positions on an outbound pass and a return pass during bidirectional printing in which ink droplets of a plurality of dot sizes are discharged from a recording head on both the outbound and return passes of the recording head to print images on a print medium, the control method comprising:

storing, in a storage unit, adjustment values set for each dot size according to the amount of deviation;

converting image data to raster data and storing the raster data;

recognizing ordered dot data as a ruled line when a plurality of dots are converted in an ordered line in a direction perpendicular to the raster direction, determining if the number of ruled lines exceeds a predetermined threshold count in the raster direction, controlling bidirectional printing using a large-dot adjustment value stored in the storage unit when the number of ruled lines exceeds the predetermined threshold count.

6. The printing device control method described in claim 5, wherein the control step includes:

determining if the number of ruled lines exceeds a predetermined threshold count in the raster direction for each group of raster data equal to one scan of the recording head, acquiring the adjustment value for a dot size other than the large dot size stored in the storage unit, and controlling bidirectional printing using the acquired adjustment value if the number of ruled lines does not exceed the predetermined threshold count in the raster direction for each group of raster data equal to one scan of the recording head.

7. A program causing a computer to execute the control method described in claim 6.

8. A program causing a computer to execute the control method described in claim 5.

9. A computer-readable recording medium storing the program described in claim 8.

* * * * *